US010170256B2

(12) United States Patent
Pierres et al.

(10) Patent No.: US 10,170,256 B2
(45) Date of Patent: Jan. 1, 2019

(54) CIRCUIT BREAKER EQUIPPED WITH AN EXTENSIBLE EXHAUST COVER

(71) Applicant: General Electric Technology GmbH, Baden (CH)

(72) Inventors: Emilien Pierres, Lyons (FR); Nicolas Toquet, Saint Thibaud de Couz (FR); Roger Ledru, Tignieu (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 15/544,969

(22) PCT Filed: Jan. 25, 2016

(86) PCT No.: PCT/EP2016/051411
§ 371 (c)(1),
(2) Date: Jul. 20, 2017

(87) PCT Pub. No.: WO2016/120188
PCT Pub. Date: Aug. 4, 2016

(65) Prior Publication Data

US 2018/0012715 A1 Jan. 11, 2018

(30) Foreign Application Priority Data

Jan. 28, 2015 (FR) ..... 15 50648

(51) Int. Cl.
*H01H 33/70* (2006.01)
*H01H 33/74* (2006.01)
(Continued)

(52) U.S. Cl.
CPC ..... *H01H 33/7015* (2013.01); *H01H 33/53* (2013.01); *H01H 33/74* (2013.01);
(Continued)

(58) Field of Classification Search
CPC .... H01H 33/53; H01H 33/7015; H01H 33/56; H01H 33/74; H01H 33/90; H01H 33/94;
(Continued)

(56) References Cited

U.S. PATENT DOCUMENTS 5,534,673 A * 7/1996 Lehmann ..... H01H 9/04 218/68
7,820,933 B2 * 10/2010 Heiermeier ..... H01H 33/901 218/60

(Continued)

FOREIGN PATENT DOCUMENTS

DE 10 2011 083 593 A1 3/2013

OTHER PUBLICATIONS

Search Report issued in French Patent Application No. 15 50648 dated Nov. 2, 2015.
International Search Report issued in Application No. PCT/EP2016/051411 dated Mar. 23, 2016.

(Continued)

*Primary Examiner* — Renee S Luebke
*Assistant Examiner* — William Bolton
(74) *Attorney, Agent, or Firm* — Pearne & Gordon LLP

(57) ABSTRACT

The invention relates to a medium-, high-, or very high-voltage circuit breaker, comprising at least one arc-control chamber and an outer casing in which the arc-control chamber is arranged. The circuit breaker includes a discharge cap (40) forming a portion of the outer wall external of the arc-control chamber (12), the discharge cap being situated inside the outer casing and internally defining a gas-flow chamber (31). In the invention, the discharge cap (40) includes at least one portion (40') that is movable under the effect of the gas pressure in the gas-flow chamber (31), in such a manner that its volume is extensible.

8 Claims, 4 Drawing Sheets

(51) Int. Cl.
*H01H 33/53* (2006.01)
*H01H 33/90* (2006.01)
*H01H 33/91* (2006.01)

(52) U.S. Cl.
CPC ..... *H01H 33/7023* (2013.01); *H01H 33/90* (2013.01); *H01H 33/904* (2013.01); *H01H 33/91* (2013.01)

(58) Field of Classification Search
CPC ..... H01H 33/91; H01H 2033/888; H01H 2033/902; H01H 2033/906; H01H 2009/526
USPC ..... 218/47, 13, 14, 56, 57, 59, 60, 61, 97
See application file for complete search history.

(56) References Cited

U.S. PATENT DOCUMENTS

| | | | | |
|---|---|---|---|---|
| 8,779,316 | B2 * | 7/2014 | Drews | H01H 33/74 218/51 |
| 2007/0068904 | A1 | 3/2007 | Dahlquist | |
| 2014/0209568 | A1 * | 7/2014 | Cernat | H01H 33/7015 218/51 |
| 2015/0008214 | A1 * | 1/2015 | Yeon | H01H 33/905 218/59 |

OTHER PUBLICATIONS

Written Opinion issued in Application No. PCT/EP2016/051411 dated Mar. 23, 2016.

* cited by examiner

CIRCUIT BREAKER EQUIPPED WITH AN EXTENSIBLE EXHAUST COVER

TECHNICAL FIELD

The invention relates to the field of medium-, high-, or very high-voltage circuit breakers. The invention relates more particularly to the problem of dimensioning such a circuit breaker, which dimensioning depends in particular on the need for the discharge cap fitted on the arc-control chamber to define a minimum volume, and on the minimum electrical insulation distance between said discharge cap and the outer casing of the circuit breaker in which the arc-control chamber is arranged.

STATE OF THE PRIOR ART

From the prior art, numerous circuit breaker designs are known, such as for example, that described in document DE 10 2011 083593. Such a circuit breaker is incorporated in an arc-control chamber that is fitted with a discharge cap defining a gas-flow chamber, also referred to as a discharge chamber. The hot gas resulting from an electric arc formed during interruption of the current in the circuit breaker is directed towards the gas-flow chamber.

In order to limit the temperature and the gas pressure in the gas-flow chamber, that chamber must be of rather large volume, in particular in order to be able to interrupt high currents. In this respect, it is noted that a discharge volume that is too small can limit the flow of hot gas out from the breaking zone, and can thus limit the breaking performance of the circuit breaker.

Furthermore, the arc-control chamber is placed in a space defined by an outer casing of the circuit breaker. For certain applications such as for circuit breakers of the gas-insulated switchgear (GIS) or "dead tank" type, a minimum electrical insulation distance is generally necessary between the outer casing of the circuit breaker and the discharge cap forming the outer wall of the arc-control chamber. This minimum distance is fixed in such a manner as to limit the risks of electric arcing between a portion of the chamber that is electrically charged (at non-zero potential), and the metal outer casing of the circuit breaker that is at zero potential.

These dimensioning constraints have a direct impact on the size, the overall weight, and the cost of such circuit breakers.

There is consequently a need to optimize the design of such circuit breakers, in such a manner as to improve their breaking performance and to reduce their size, while at the same time enabling them to correctly address the above-mentioned technical constraints.

SUMMARY OF THE INVENTION

In order to meet this need, the invention provides a medium-, high-, or very high-voltage circuit breaker, comprising at least one arc-control chamber and an outer casing defining a space in which the arc-control chamber is arranged, said arc-control chamber comprising:

- a first set of electrical contacts and a second set of electrical contacts, arranged at least in such a manner as to enable closing and opening operations of the circuit breaker;
- an arc blast nozzle; and
- a discharge cap forming a portion of the outer wall of the arc-control chamber, the discharge cap being situated in the space and internally defining a gas-flow chamber situated at least in part downstream from the blast nozzle with which it communicates, said discharge cap being suitable for including one or more openings for discharging the gas from the gas-flow chamber towards said space; and
- a support that is electrically insulating and that mechanically connects the arc-control chamber to an end wall of the outer casing of the circuit breaker.

According to the invention, the discharge cap comprises at least one portion that is movable under the effect of the gas pressure in the gas-flow chamber, in such a manner that its volume is extensible, so as to limit the pressure in said gas-flow chamber.

The invention is thus advantageous in that it provides an extensible discharge cap, in such a manner as to allow the volume of the gas-flow chamber to increase in the event of interrupting high currents. Also, in the nominal configuration, i.e. when the circuit breaker is in the closed position, or in the event of interrupting a low current producing little hot gas, the discharge cap is of smaller size and that makes it possible to reduce the overall size of the circuit breaker. In addition, for circuit breakers of the GIS or dead tank type, the invention is advantageous in that this reduction of size is not made to the detriment of the dielectric insulation of the chamber relative to the outer casing of the circuit breaker. The risk of electric arcing remains under control, even when the movable portion of the discharge cap moves in the direction of the outer casing of the circuit breaker, under the effect of the gas pressure, in the event of strong currents. This can be explained by the fact that during relative movement between the two elements under consideration, the spacing constraint between these two elements is considerably less than that required in a static situation, e.g. of the order of 40% less.

In other words, the invention advantageously makes it possible to reduce the size of the circuit breaker while strongly limiting the risks of high-pressure gas in the gas-flow chamber, as well as the risk of electric arcing between the discharge cap and the outer casing of the circuit breaker.

In addition, the invention is remarkable in that the extension of the volume of the gas-flow chamber takes place in automatic and reliable manner, by means of the simple physical phenomenon of gas pressure on the movable portion of said cap. In addition, this extension takes place only when high currents are present (generally 60% to 100% of the nominal short-circuit current), which happens rarely, and that implies that actuation is not very frequent, and therefore that there is a low risk of producing wear particles.

Furthermore, during an operation of opening the circuit breaker, that also leads to seeing an increase in the pressure differential between the core of the chamber and the discharge. Advantageously, this results in gas flowing better, and in better arc blasting, and therefore in increased breaking capacity for the circuit breaker. These benefits are considerable, since the increase in the volume of the discharge chamber may be large. This is explained by the fact that the movable portion, defining this volume, forms a portion of the outer wall of the discharge cap, so its diameter is thus at its maximum.

In addition, with the solution that is specific to the invention, at least part of the hot gas resulting from arc blasting remains confined in the chamber of increased volume, which limits the risks of attack by said hot gas or of electric arcing in the outer casing of the circuit breaker.

Finally, since the pressure in the discharge chamber is thus reduced, the mechanical forces in the various parts of the circuit breaker are advantageously reduced.

The invention further provides at least one of the following optional characteristics, alone or in combination.

Said movable portion of said discharge cap is arranged around the support mechanically connecting the arc-control chamber to the end wall of the outer casing.

Said movable portion of said discharge cap is mounted to move in sliding on a stationary portion of this cap, preferably along a longitudinal central axis of said cap.

The circuit breaker includes resilient return means for returning said movable portion of said discharge cap to a rest position in which the volume of the gas-flow chamber is at a minimum.

The discharge cap is configured so that in the two end positions of its movable portion, it defines respective minimum and maximum volumes for the gas-flow chamber, the ratio between the minimum and maximum volumes preferably lying in the range 0.9 to 0.5.

Finally, a stationary portion of the discharge cap presents a first inside surface for externally defining the gas-flow chamber, in that said movable portion of said discharge cap presents a second inside surface for externally defining the gas-flow chamber, and in that a maximum diameter of the second inside surface is greater than a maximum diameter of the first inside surface. This specificity makes it possible to further amplify the increase in the volume of the chamber, in the event of movement of the movable portion of the discharge cap, under the effect of the gas pressure in said chamber.

Other advantages and characteristics of the invention appear in the non-limiting detailed description given below.

BRIEF DESCRIPTION OF THE DRAWINGS

This description is made with reference to the accompanying drawings in which.

DETAILED DESCRIPTION OF PARTICULAR EMBODIMENTS

Figure 1:
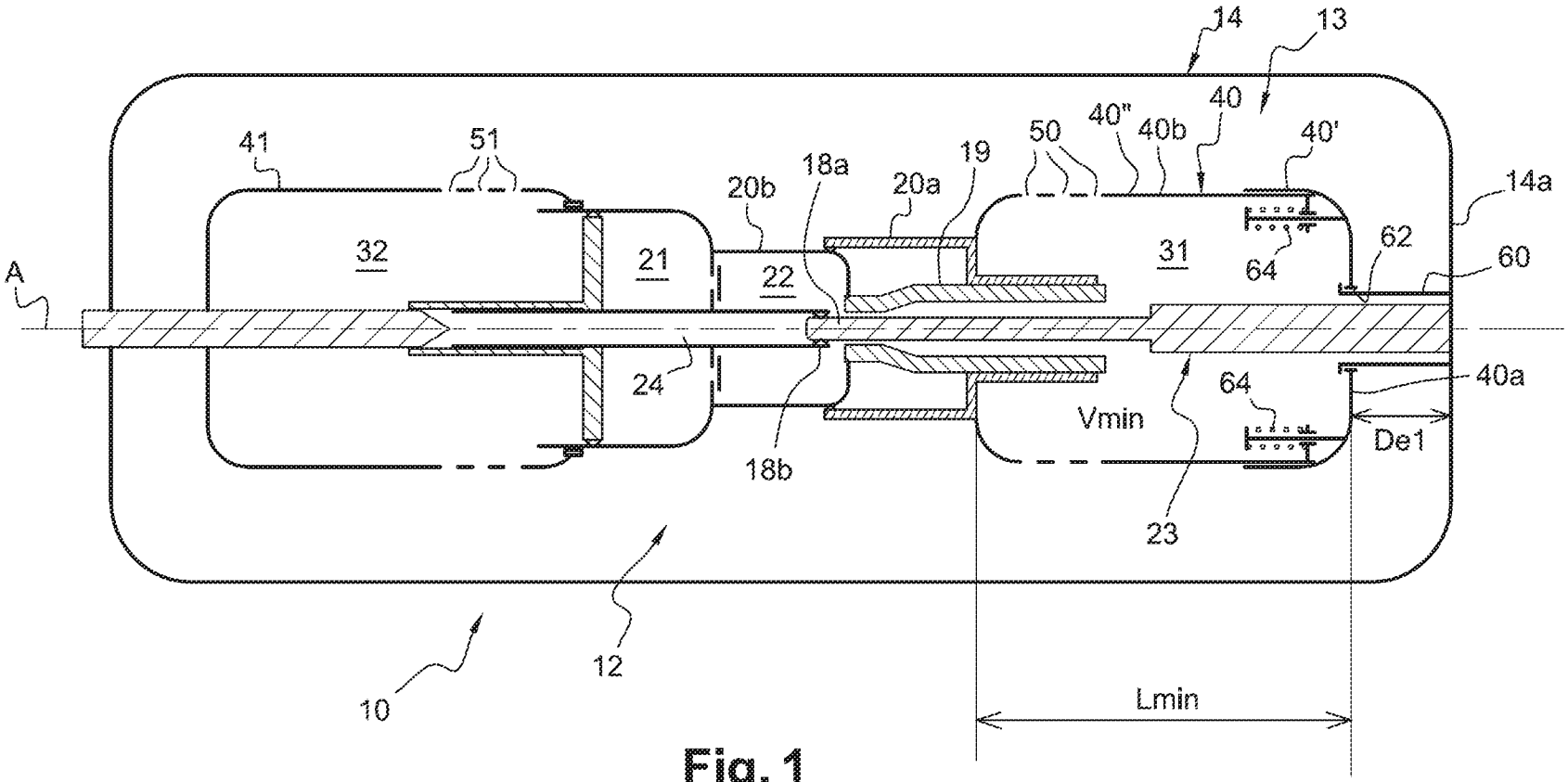
FIGS. 1 and 2 are diagrammatic views in longitudinal section of a high-voltage circuit breaker of the invention, with the circuit breaker being shown respectively in a closed position and in a position occupied during an operation of opening the circuit breaker, in order to interrupt a high current.
Figure 2:
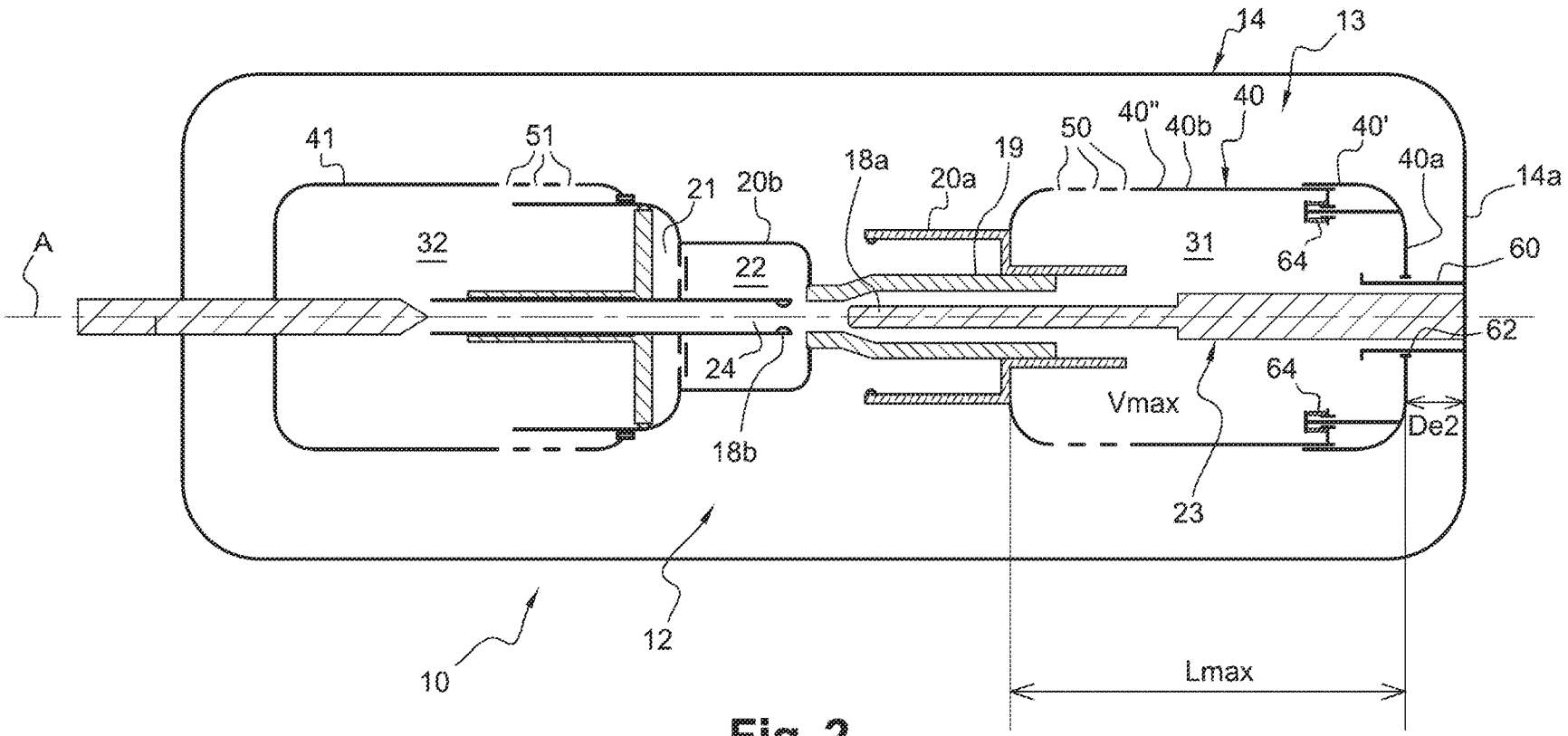

With reference initially to FIGS. 1 and 2, there can be seen a high-voltage circuit breaker 10 of the invention. In these figures, the circuit breaker is shown diagrammatically, so as to focus on the principle forming the object of the invention. In this respect, it should be noted that this principle is applicable to all existing circuit breaker configurations, and in particular to the shielded circuit breakers of the GIS or dead tank type that are described below in reference to FIGS. 3*a* to 4*b*.

The circuit breaker 10 includes an arc-control chamber 12. The arc-control chamber 12 is arranged inside a casing 14. The arc-control chamber 12 is thus housed inside a space 13 that is defined internally by the outer casing 14. This space 13 is usually filled with an insulating gas under pressure, e.g. of the $SF_6$ type.

The chamber 12 includes a first set of electrical contacts 18*a*, 20*a*, and a second set of contacts 18*b*, 20*b*. More precisely, the first set comprises a first permanent contact 20*a* co-operating with a second permanent contact 20*b* of the second set, when the circuit breaker is in a closed position such as that shown in FIG. 1. In addition, the first set comprises a first arcing contact 18*a*, co-operating with a second arcing contact 18*b* of the second set, when the circuit breaker is in its closed position. The first arcing contact 18*a* passes through a blast nozzle 19, made in conventional manner.

However, the invention is not limited to this embodiment. The invention may in particular be applied to double-motion circuit breakers. In order to perform such movement, any design deemed appropriate by the person skilled in the art may be used, e.g. the design described in French patent document No. FR 2 976 085. In such an example, the two sets are thus movable in sliding along the main axis A of the arc-control chamber 12, in opposite directions.

The second arcing contact 18*b* is surrounded by two volumes 21 and 22 separated axially from each other by a wall, and enabling the electric arc to be extinguished by blasting, so as to interrupt the current. The blast nozzle 19 makes it possible to channel the gas stream during said blasting.

The gas from the electric arc and the volumes 21 and 22 is evacuated axially on both sides by the nozzle 19 and the inside space 24 of the second arcing contact 18*b*. The gas escaping from the nozzle 19 penetrates into the gas-flow chamber 31, also called the discharge chamber, and defined by a discharge cap 40 housed in the space 13. The chamber 31 is thus arranged at least in part downstream from the nozzle 19, the term "downstream" being in this example considered along a main axial direction of gas flow in the chamber 12, at the outlet of the nozzle 19.

In analogous manner, opposite the arc-control chamber, the gas being discharged via the space 24 penetrates into the other gas-flow chamber 32, defined by a discharge cap 41 that is also housed in the space 13.

Beside the first set of contacts 18*a*, 20*a*, the arc-control chamber 12 thus includes the discharge cap 40 forming the discharge volume 31 and forming a portion of the outer wall of the arc-control chamber 12. The discharge cap 40 preferably includes a plurality of openings 50 that make it possible to evacuate gas towards the space 13 defined by the tank 14. In FIGS. 1 and 2, these openings 50 are arranged near an upstream end of the cap 40, but they may naturally be arranged differently on the cap 40. In addition, the invention is applicable whatever the configuration inside the chamber 31.

In addition, beside the second set of contacts 18*b*, 20*b*, the discharge cap 41, defining the discharge volume 32, includes a plurality of openings 51 for evacuating gas from the breaking zone towards the space 13.

The discharge cap 40 defines a substantially cylindrical chamber 31 of axis A corresponding to the longitudinal central axis of said cap 40, with a substantially circular section. This cap 40 includes an end wall 40*a* that is substantially orthogonal to the axis A, as well as a side wall 40*b* surrounding said axis A. The end wall 40*a* and the side wall 40*b* of the cap thus form part of the outer wall of the arc-control chamber 12, situated in the volume 13 remote from the outer casing 14. In this respect, this casing 14 includes an end wall 14*a* that is also arranged substantially orthogonally to the axis A. A support 60, of axis A, is provided mechanically connecting and electrically insulating the end walls 14*a*, 40*a*. This support 60 preferably takes the shape of a hollow cylinder, allowing the movable elements of a control mechanism 23 to pass internally therethrough.

One of the features of the invention resides in the fact that the discharge cap 40 presents a movable portion 40' mounted to slide on a stationary portion 40". The movable portion 40' corresponds to the end wall 40*a*, as well as to a downstream end of the side wall 40*b*. The stationary portion 40" corresponds to the remainder of the cap, and in addition it is specified that these two portions 40', 40" are both centered on the axis A and are substantially cylindrical.

More precisely, the movable portion 40' has an opening 62 in the center of its end wall 40*a* with the support 60 passing therethrough, the movable portion being mounted slide on the support 60 along the axis A. The movable portion 40' is thus arranged around the support 60, while being able to move along it, preferably in leaktight manner.

Resilient return means such as compression springs 64 are interposed between the two portions 40', 40", preferably while being arranged inside the chamber 31. These springs 64 exert a return force that forces the movable portion 40' to position itself in a rest position, in which the volume of the gas-flow chamber 31 is a minimum volume Vmin. This configuration is shown in FIG. 1. It is the configuration that is occupied in the closed position, or even also during interruption of a low current.

In this position, the movable portion 40' occupying a first end position is retracted as far as possible into the stationary portion 40", so that the distance between the two ends of the cap along the axis A corresponds to a minimum distance, given reference Lmin in FIG. 1. That makes it possible to obtain a satisfactory spacing distance De1 between the two end walls 40*a*, 14*a*, taking into consideration the risk of arcing between these two elements, in the static position.

For opening in order to interrupt high currents, the high gas pressure in the chamber 31 generates pressure on the movable portion 40' that causes it to be pushed back towards the end wall 14*a*, against the return forces generated by the springs 64.

FIG. 2 shows the second end position of the movable portion 40', after it has been moved along the support 60, under the effect of the gas pressure in the chamber 31. In this second end position, the movable portion 40' is extended as far as possible relative to the stationary portion 40", so that the distance between the two ends of the cap along the axis A corresponds to a maximum distance, given reference Lmax in FIG. 2. In this second end position, the volume of the gas-flow chamber 31 is a maximum volume Vmax and the relationship between the two volumes Vmin and Vmax may lie in the range 0.9 to 0.5.

Moving the movable portion 40' into the second end position results in obtaining a shorter spacing distance De2 between the two end walls 40*a*, 14*a*. Nevertheless, even with this shorter spacing distance, the risk of arcing remains under control. Indeed, the voltage between the arc-control chamber 12 and the outer casing 14 of the circuit breaker during interruption of high currents is considerably less than that necessary in a static situation. Respectively, the electrical insulation distance required during interruption of high currents is considerably less than the distance necessary in a static situation, for example about 40% less. Also, despite the small spacing distance, the risk of arcing advantageously proves to be very limited during the stage of moving the movable member 40'.

The design selected thus makes it possible to obtain smaller overall size for the circuit breaker that is determined by the first end position of the movable portion 40', while limiting the risk of arcing with the outer casing 14.

In addition, it is specified that during interruption of a high current, a flow of gas from the zone between the contacts 18*a* and 18*b* towards the discharge chambers 31, 32 is created in the chamber 12. Under the effect of the pressure exerted by the gas in the chamber 31, the movable portion 40' of the discharge cap 40 is pushed back towards the end wall 14*a*, as described above. The hot gas that results from blasting the electric arc can pass through the openings 50 before reaching the large-volume space 13, when such openings 50 are provided. Nevertheless, the expansion of the volume of the chamber 31 results in a decrease in pressure and in temperature of the gas, and confines an essential part of said gas inside the cap 30. The risk of the casing 14 being attacked by this same gas and the microparticles that it entrains consequently proves limited. The same applies for the risk of arcing related to the presence of this hot gas inside the space 13.

In addition, since the gas pressure in the chamber 31 is decreased by the extension of its volume, the mechanical forces required for moving the electrical contacts and the stresses in the mechanical interfaces of the circuit breaker are advantageously reduced.

In addition, blasting of the electric arc is also improved, thus reinforcing the breaking performance of the circuit breaker, because of the increase in the pressure difference between the core of the nozzle 19 and the discharge chamber 31.

Finally, it should be observed that the principle of the invention is also applicable for the second set of contacts 18*b*, 20*b*, on the cap 41. The invention is also applicable to discharge chambers 31, 32 that are closed, i.e. without openings 50 and 51.

Figure 3A:
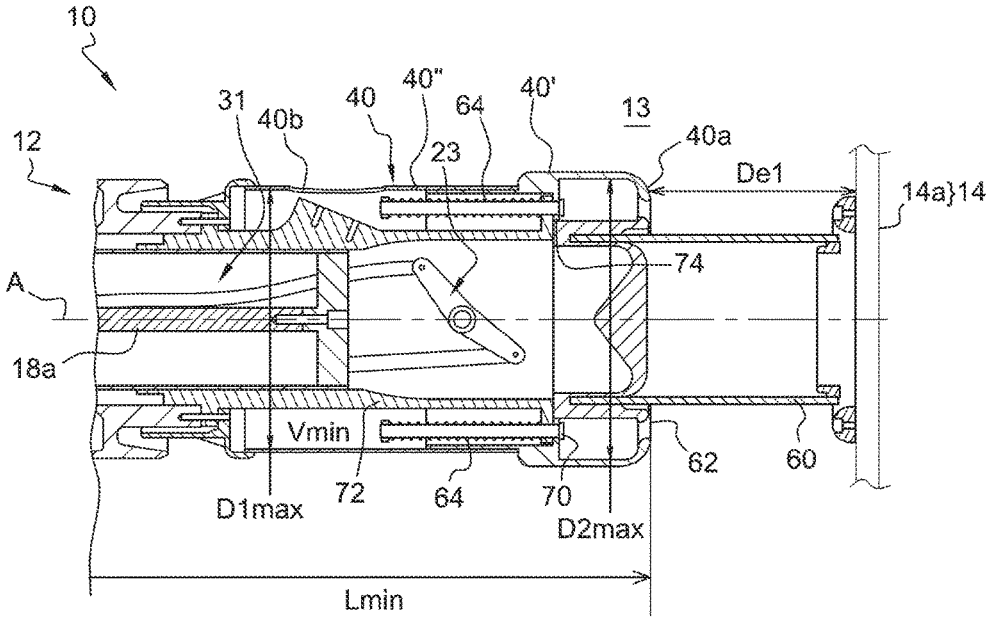
FIGS. 3*a* and 3*b* are views that are respectively similar to the views of FIGS. 1 and 2, with the circuit breaker in the form of a preferred first embodiment of the invention.
Figure 3B:
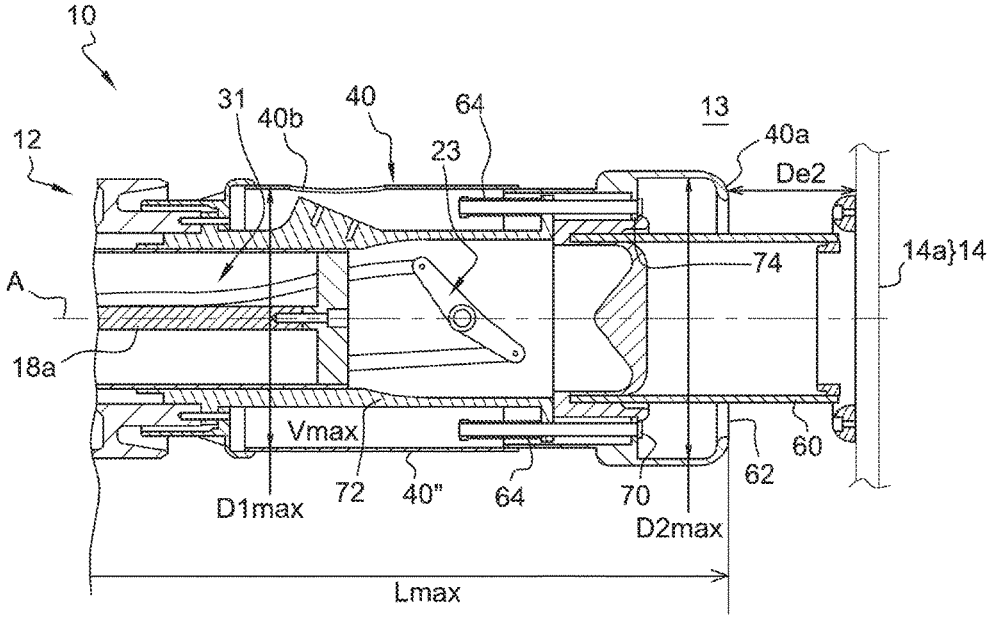

With reference to FIGS. 3*a* and 3*b*, there can be seen a shielded circuit breaker 10 of dead tank type, in a first preferred embodiment of the invention. In these figures, there can be seen the control mechanism for controlling both sets of contacts, 18*a* & 20*a* and 18*b* & 20*b*, this mechanism being conventional and identified by the general numerical reference 23. In these figures, the elements having the same numerical references as those given to elements of FIGS. 1 and 2, correspond to elements that are identical or similar.

In this first embodiment, the movable portion 40' includes a downstream end of larger section, so as to further increase the volume of the chamber 31 in the event of abnormally high currents. More precisely, the movable portion 40' includes an intermediate inside wall 70, that is substantially orthogonal to the axis A and that is perforated by an opening 74. Upstream, this wall 70 defines the expanded end of the movable portion 40', and it is this portion that slides along the support 60. The end wall 40*a* is also arranged around the support 60, but is radially remote therefrom in order to allow gas to escape towards the space 13, between the opening 62 and the support 60.

In the first end position of the movable portion 40', shown in FIG. 3*a*, the intermediate wall 70 is pressed against an inside piece of equipment 72 of the chamber 31. The volume defined by the cap 40 then corresponds to the minimum volume Vmin, not including the volume defined internally by the expanded downstream end. In contrast, in the event of movement of the movable portion 40' under the effect of the gas pressure in the chamber 31, the intermediate wall 70 moves away from the inside equipment 72. The two volumes situated upstream and downstream from said wall 70 then combine so that together they form the volume Vmax of the chamber 31, as shown in FIG. 3*b*. Gas can then penetrate into the additional volume defined internally by the expanded downstream end of the portion 40' in movement. In this respect, it should be observed that the substantially cylindrical stationary portion 40" has a first inside surface for externally defining the chamber 31. In this example, its maximum diameter D1max is a substantially constant diameter, and it is less than the maximum diameter D2max of a second inside surface for externally defining the chamber 31 that is defined by the downstream end of the movable portion 40'. The ratio between the two diameters D1max and D2max can for example lie between 0.9 and 0.5.

Figure 4A:
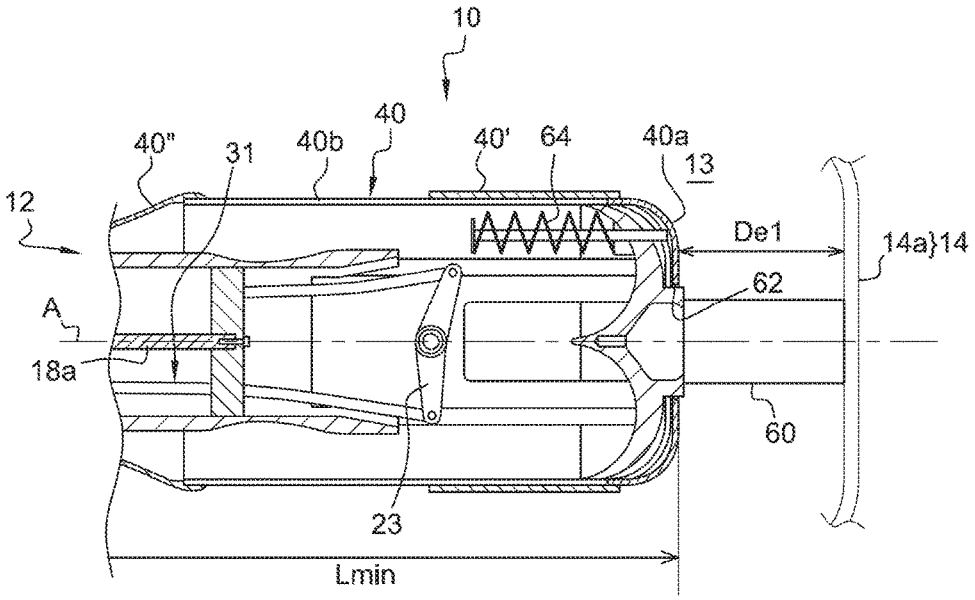
FIGS. 4*a* and 4*b* are views that are respectively similar to the views of FIGS. 1 and 2, with the circuit breaker in the form of a preferred second embodiment of the invention.
Figure 4B:
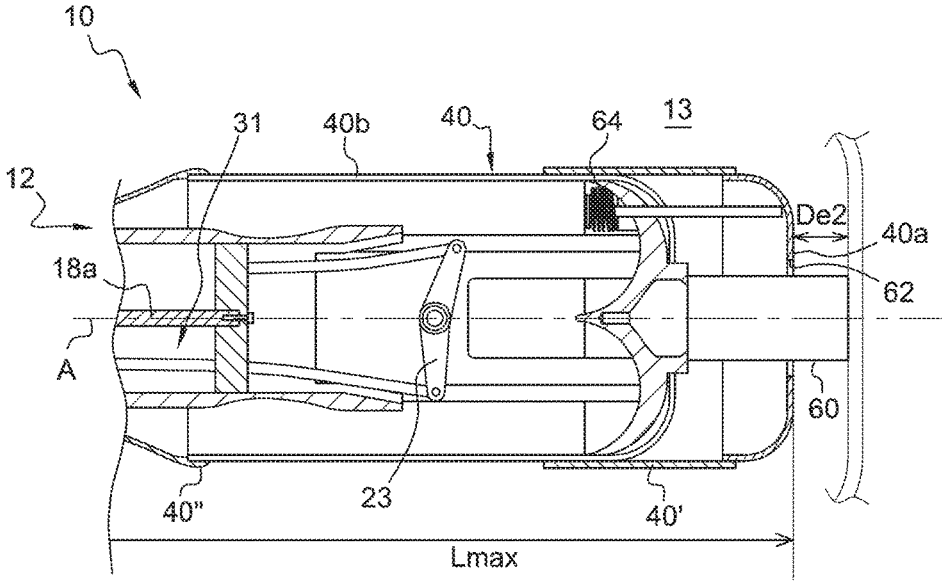

Finally, in reference to FIGS. 4*a* and 4*b*, there can be seen a shielded circuit breaker 10 of GIS type, in a second preferred embodiment of the invention. Again, in the figures, elements having the same numerical references as those given to elements of FIGS. 1 and 2 correspond to elements that are identical or similar. It may also be observed that the movable portion 40' takes a form similar to that shown in the schematic diagrams of FIGS. 1 and 2, namely incorporating both the end wall 40*a* and the downstream end of the side wall 40*b*. In this example, the inside diameters of the movable and stationary portions 40', 40" are substantially identical.

Naturally, various modifications may be applied to the above-described invention by the person skilled in the art without going beyond the ambit of the invention.

What is claimed is:

1. A medium-, high-, or very high-voltage circuit breaker, comprising at least one arc-control chamber and an outer casing defining a space in which the arc-control chamber is arranged, said arc-control chamber comprising:

a first set of electrical contacts and a second set of electrical contacts, arranged at least in such a manner as to enable closing and opening operations of the circuit breaker;

an arc blast nozzle; and a discharge cap forming a portion of an outer wall of the arc-control chamber, the discharge cap being situated in the space and internally defining a gas-flow chamber situated at least in part downstream from the blast nozzle with which the gas-flow chamber communicates, said discharge cap being suitable for including one or more openings for discharging a gas from the gas-flow chamber towards said space; and a support that is electrically insulating and that mechanically connects the arc-control chamber to an end wall of the outer casing of the circuit breaker;

wherein the discharge cap comprises at least one portion that is movable under an effect of a gas pressure in the gas-flow chamber, so that a volume of the discharge cap is extensible.

2. The circuit breaker according to claim 1, wherein said movable portion of said discharge cap is arranged around the support mechanically connecting the arc-control chamber to the end wall of the outer casing.

3. The circuit breaker according to claim 1, wherein said movable portion of said discharge cap is mounted to move in sliding on a stationary portion of the discharge cap.

4. The circuit breaker according to claim 3, wherein the movable portion of the discharge cap slides on the stationary portion of the discharge cap along a longitudinal central axis (A) of said discharge cap.

5. The circuit breaker according to claim 1, further comprising resilient return means for returning said movable portion of said discharge cap to a rest position in which a volume (Vmin) of the gas-flow chamber is at a minimum.

6. The circuit breaker according to claim 1, wherein the discharge cap is configured so that in two end positions of said movable portion, the discharge cap defines respective minimum and maximum volumes (Vmin, Vmax) for the gas-flow chamber.

7. The circuit breaker according to claim 6, wherein a ratio between the minimum and maximum volumes lies in a range of 0.9 to 0.5.

8. The circuit breaker according to claim 1, wherein a stationary portion of the discharge cap presents a first inside surface for externally defining the gas-flow chamber, in that said movable portion of said discharge cap presents a second inside surface for externally defining the gas-flow chamber, and in that a maximum diameter (D2max) of the second inside surface is greater than a maximum diameter (D1max) of the first inside surface.

* * * * *